United States Patent [19]

Bridges

[11] Patent Number: 4,654,540

[45] Date of Patent: Mar. 31, 1987

[54] GROUP OPERATED CIRCUIT DISCONNECT APPARATUS FOR OVERHEAD ELECTRIC POWER LINES

[76] Inventor: Ronald P. Bridges, 13 Westpoint, Heber Springs, Ark. 72543

[21] Appl. No.: 785,129

[22] Filed: Oct. 7, 1985

[51] Int. Cl.[4] ..... H01H 35/00; H01H 31/00

[52] U.S. Cl. ..... 307/126; 307/139; 200/48 R; 200/48 SB; 174/45 R; 52/726

[58] Field of Search ..... 200/48 R, 162, 48 KB, 200/48 CB, 48 V, 48 SB, 48 P, 48 A, 153 R, 337, 271; 74/99, 469; 335/68, 69; 307/126, 139; 174/45 R, 149 R; 52/648, 301, 726, 299, 693, 637, 650, 697, 721, 40; 248/65, 311.2, 219.4

[56] References Cited

U.S. PATENT DOCUMENTS

| | | | |
|---|---|---|---|
| Re. 30,784 | 10/1981 | Bridges | 200/48 KB |
| 1,935,111 | 11/1933 | Christensen et al. | 200/48 R |
| 2,194,021 | 3/1940 | Johnson | 200/48 R |
| 2,242,092 | 5/1941 | Schultz | 200/48 R |
| 2,306,117 | 12/1942 | Dunlap | 200/48 R |
| 2,575,707 | 11/1951 | Gilliland et al. | 200/48 A |
| 2,579,771 | 12/1951 | Warren et al. | 200/48 R |
| 3,284,590 | 11/1966 | Hondalus | 200/48 R |
| 3,653,622 | 4/1972 | Farmer | 174/52 R X |
| 3,884,442 | 5/1975 | Breeden et al. | 174/45 R X |
| 4,069,638 | 1/1978 | Hasselquist et al. | 52/726 |
| 4,095,061 | 6/1978 | Bridges | 200/48 KB |
| 4,103,121 | 7/1978 | Rogers et al. | 200/48 R X |
| 4,112,268 | 9/1978 | Chung | 200/48 SB |
| 4,127,739 | 11/1978 | Farmer | 174/45 R |
| 4,194,080 | 3/1980 | Meisberger | 174/45 R |
| 4,314,434 | 2/1982 | Meisberger | 174/45 R X |
| 4,357,505 | 11/1982 | Bridges | 200/48 KB |
| 4,563,554 | 1/1986 | Perrenoud | 200/48 R |

FOREIGN PATENT DOCUMENTS

| | | | |
|---|---|---|---|
| 2009759 | 9/1971 | Fed. Rep. of Germany | 200/48 |

OTHER PUBLICATIONS

Brochure entitled "S&C Electric Company High Voltage Switching and Protection Products", dated Apr. 1985.

Brochure entitled "Chance Overhead Distribution Switches", undated.

*Primary Examiner*—William M. Shoop, Jr.
*Assistant Examiner*—Shik Luen Paul Ip
*Attorney, Agent, or Firm*—Wood, Dalton, Phillips, Mason & Rowe

[57] ABSTRACT

A group operated electric circuit disconnect apparatus for a plurality of overhead electric power distribution lines carried on poles. The apparatus includes an elongated extruded base mounted on and extending transversely of a pole. A bracket is connected to an electric circuit component. The elongated base has at least one elongated slot with a reduced dimensioned entry. The bracket is positioned and secured at any position along the base by fasteners having enlarged head portions mating within the slot.

19 Claims, 6 Drawing Figures

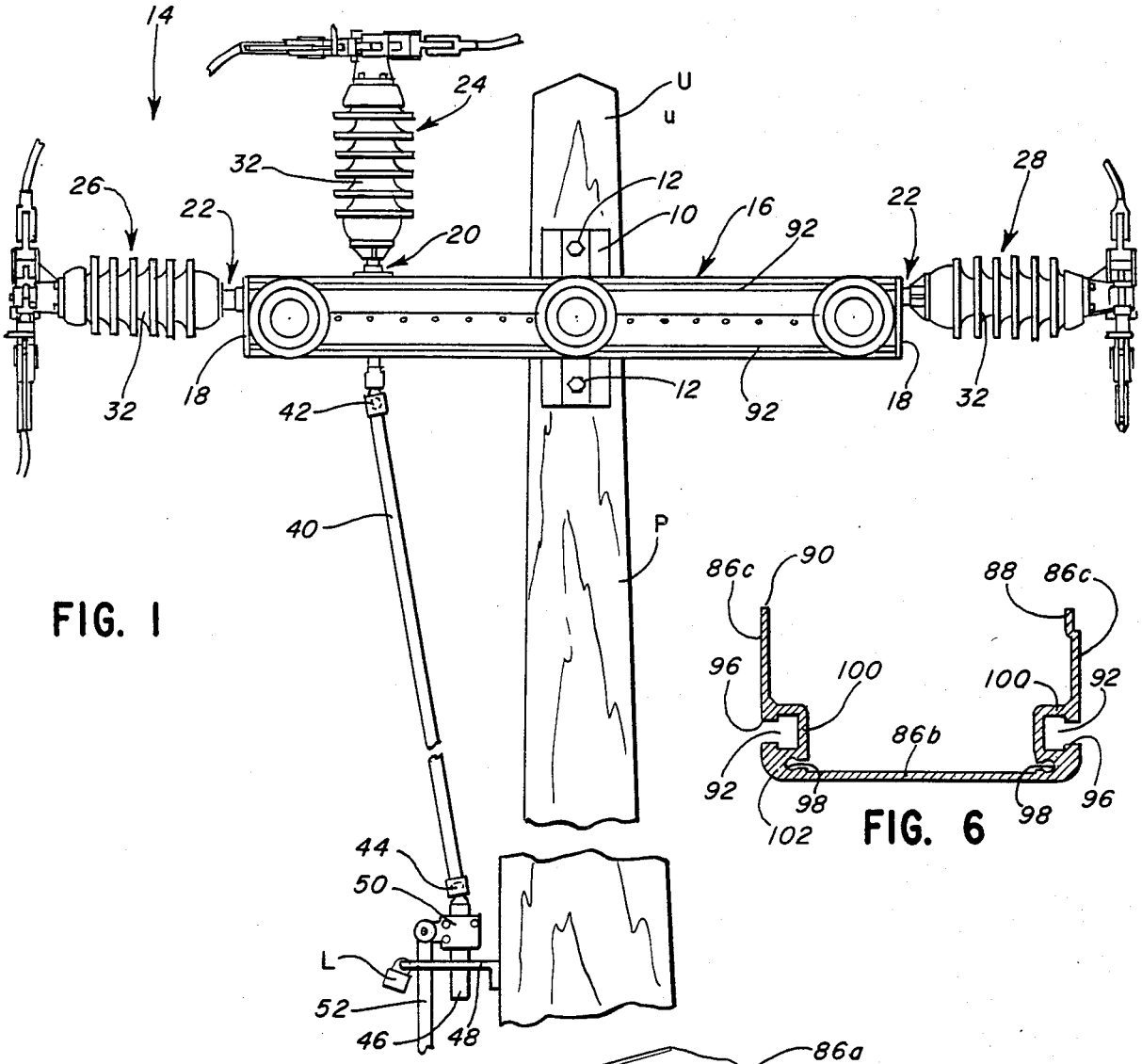
FIG. 1
FIG. 6
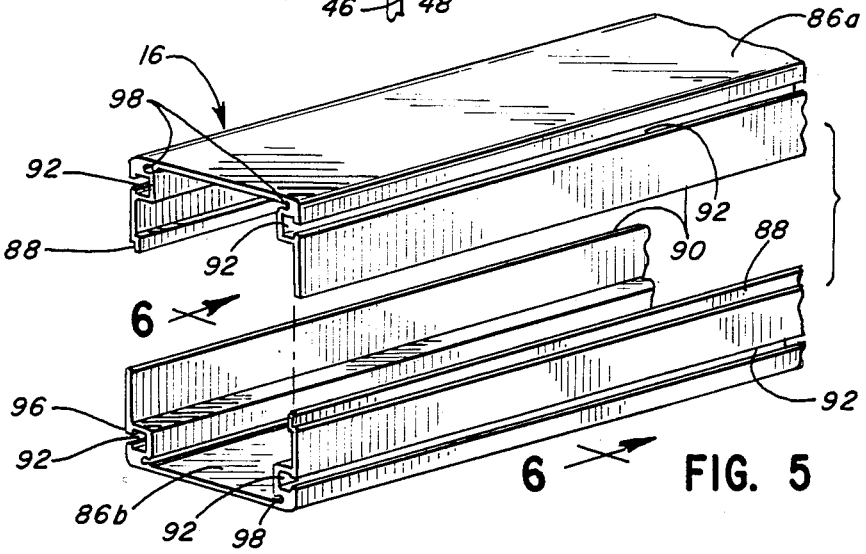
FIG. 5

GROUP OPERATED CIRCUIT DISCONNECT APPARATUS FOR OVERHEAD ELECTRIC POWER LINES

BACKGROUND OF THE INVENTION

This invention relates generally to electric circuit apparatus and, more particularly, to group operated circuit disconnect apparatus for overhead electric power distribution lines carried on poles.

Overhead electric power distribution lines are mounted upon poles by a wide variety of mounting structures. The poles may be 40–50 feet high and the mounting means often carry various distribution apparatus. For instance, the distribution lines require circuit disconnect means at certain locations. Since such distribution lines commonly operate in a three-phase system, there are three associated lines which ordinarily must be disconnected and reconnected simultaneously. This requires group operated switches. Support structures also are mounted intermediate or down on the pole for distribution at certain locations to various facilities remote from the main power line.

Most support structures for mounting the main power distribution lines, take-off lines, group operated switches and other related apparatus comprise elongated cross members secured intermediate their ends to the pole. There is a continuing problem of manufacturing such cross support members in a cost effective manner yet providing sufficient strength to accommodate quite large loads on the distribution lines. The major loading on the support structures comes from the line or conductor loads and is magnified in high wind conditions or during ice storms or the like. Since the support structures actually comprise a load bearing beam, this problem can be further magnified when a line take-off point is located at one end of the beam, for instance. Heretofore, the beam strength of such support structures could accommodate a load of only on the order of 2,000 pounds. This limit often is insufficient and can cause the beam to break or bend, resulting in power outages or, more importantly, dangerous down line conditions.

Another problem with many line support beams is that they are capable of mounting the distribution lines and their associated group operated switches only at selected positions lengthwise of the beam.

This invention is directed to solving these problems by providing a new and improved group operated switching apparatus including a support structure for mounting the distribution lines on a pole, the structure being efficient and inexpensive to manufacture, yet providing a strength not heretofore available. The support structure or beam can mount circuit components at any given location along the beam.

SUMMARY OF THE INVENTION

An object, therefore, of the invention is to provide a new and improved group operated electric circuit disconnect apparatus for a plurality of overhead electric power distribution lines carried on poles.

Generally, in the exemplary embodiment of the invention, the group operated switching apparatus includes an elongated base adapted for mounting on and extending transversely of a pole. Bracket means are provided for connection to an electric power distribution circuit component. Complementary interengaging means are provided between the bracket and the elongated base for supporting the bracket at any position along the base. The interengaging means include receiver means extending along a substantial portion of the elongated base, and positioning means on the bracket positionable in the receiver means at any given location therealong.

More particularly, the elongated base comprises an extruded member having a box-like configuration in cross-section. The base may be fabricated of aluminum material. At least one elongated slot is extruded lengthwise of the base and has a reduced dimensioned entry. The positioning means includes an enlarged head portion, such as the nut of a bolt on the mounting bracket, mating within the slot. In the preferred embodiment, a pair of such slots are spaced vertically of and extending generally parallel along the elongated base adjacent the corners of the box-like configuration. The corner walls of the box are thickened to provide support for the slot. This structure has proven to accommodate up to 10,000 pound loads at any given location along the base, even at an extreme end thereof.

Other features of the invention include fabricating the box-like base of a pair of generally U-shaped mirror halves each having at least one extruded slot located on opposite sides of the base when the halves are mated. The halves actually are formed from two identical lengths of a single extrusion, with one length turned end-to-end and inverted on top of the other. The box-like base has open ends and includes extruded bore means terminating at the ends of the base for receiving fastening means of appropriate end plates.

Other objects, features and advantages of the invention will be apparent from the following detailed description taken in connection with the accompanying drawings.

DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

FIG. 1 is a broken, end elevational view of a group operated circuit disconnect apparatus embodying the invention;

FIG. 5 is a fragmented, exploded perspective view of the mirror halves of the support base; and FIG. 6 is a vertical section taken generally along line 6—6 of the lower half of FIG. 5.

DETAILED DESCRIPTION OF THE PREFERRED EMBODIMENT

Figure 2:
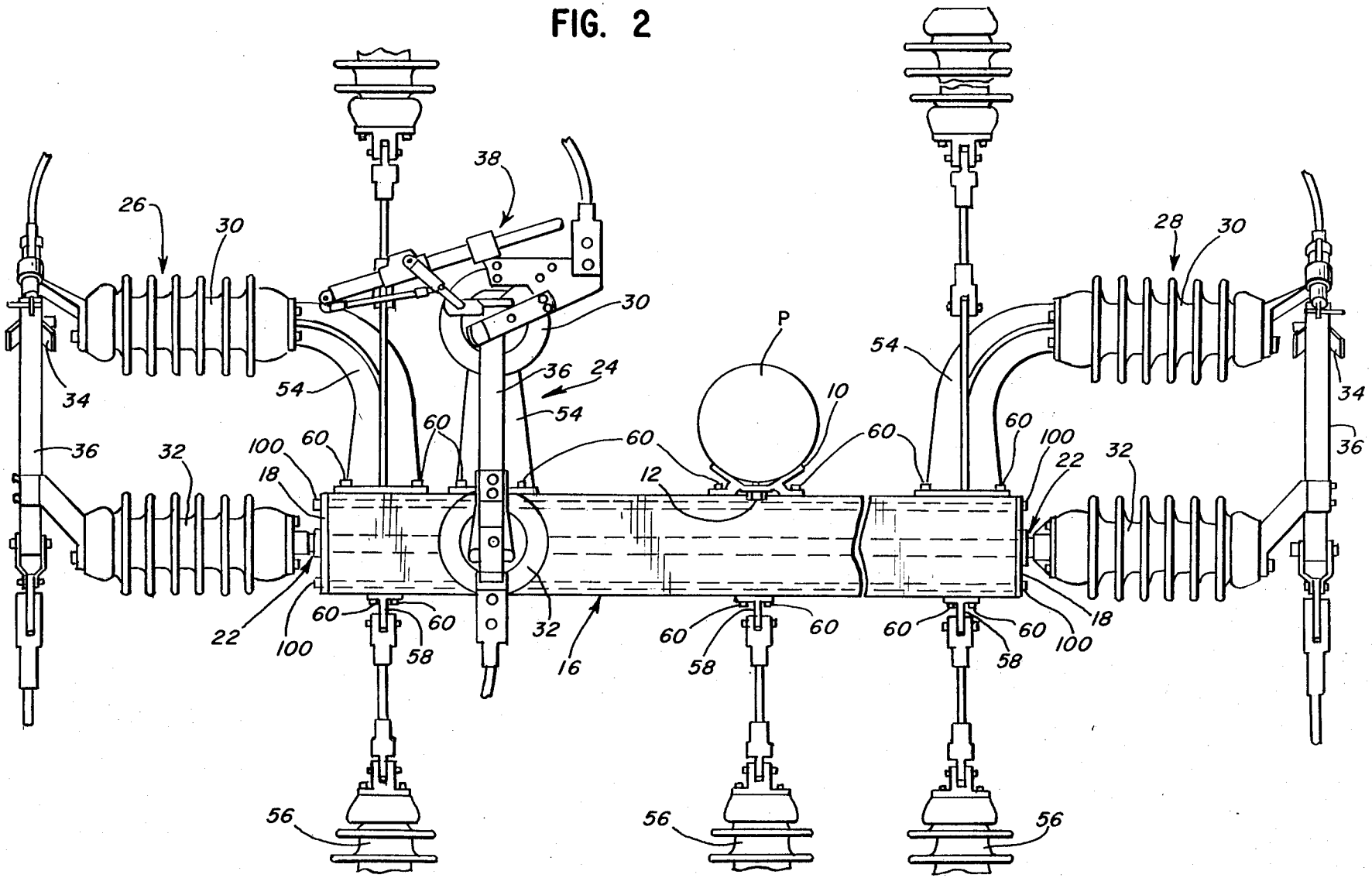
FIG. 2 is a top plan view, on an enlarged scale, of the circuit disconnect apparatus of FIG. 1.

Referring to the drawings in greater detail, and first to FIGS. 1 and 2, a pole "P" has an upper end "U" to which a mounting bracket 10 is attached by means of bolts 12. The mounting bracket is a wide channel member and, as best seen in FIG. 2, has wing portions defining a concave shape for mating with the circular periphery of the pole. The bracket secures a circuit disconnect apparatus, generally designated 14, to the pole.

Apparatus 14 includes an elongated base, generally designated 16, extending transversely of the pole and which consists of a box-like housing including end plates 18, as will be described in greater detail hereinafter.

Extending through base 16 is an upright shaft means, generally designated 20, and transverse shaft means, generally designated 22. A first disconnect switch, generally designated 24, surmounts base 16 and is operated by rotation of upright shaft means 20. Second and third disconnect switches, generally designated 26 and 28, are mounted at the ends of base 16 for operation by rotation of transverse shaft means 22.

The three disconnect switches are identical and are seen in FIG. 2 to include a fixed insulator 30, a rotatable insulator 32 mounted upon shaft means 20 or shaft means 22, a fixed jaw 34 mounted upon fixed insulator 30, and a blade 36 which is mounted upon rotatable insulator 32 for movement between a normal position in which it is held in jaw 34 and an open position rotated approximately 90° from the fixed position. If necessary for the particular operating conditions, each of the disconnect switches 24,26 and 28 may be provided with an interruptor member generally designated 38 in FIG. 2.

Simultaneous operation of all three circuit switches 24,26 and 28 from ground level is provided by an upright operating shaft 40, the upper portion of which is provided with a universal socket 42 in which the lower end of upright shaft means 20 is received. The lower end portion of operating shaft 40 includes a second universal socket or joint 44 of a stub shaft 46 rotatably received in a hole in a locking plate 48. The locking plate is bolted to the lower portion of pole "P". A pivot clamp 50, clamped on to operating shaft stub 46 just above locking plate 48, pivotally mounts an operating handle 52 which is flanked by spaced arms of locking plate 48 so that a padlock "L" may be used on the locking plate to prevent any unauthorized person from opening the switches. When the padlock is removed from the locking plate, the operating handle may be swung to a horizontal position where it affords ample leverage for rotating operating shaft 40 to open all three of the disconnect switches 24,26 and 28. The three switches are returned to their normal position by reverse rotation of the operating shaft using handle 52.

FIG. 2 shows a number of different brackets for connecting various circuit components to base 16. More particularly, fixed insulators 30 are secured by L-shaped brackets 54. Further take-off points for distribution lines are represented by insulators 56 connected by brackets 58 to base 16. Each of brackets 54 and 58, along with pole bracket 10, are secured by bolts 60 to elongated base 16 in such a manner that the brackets can be slidably positioned to any position along the base and clamped thereto, as will be described in greater detail hereinafter.

Figure 3:
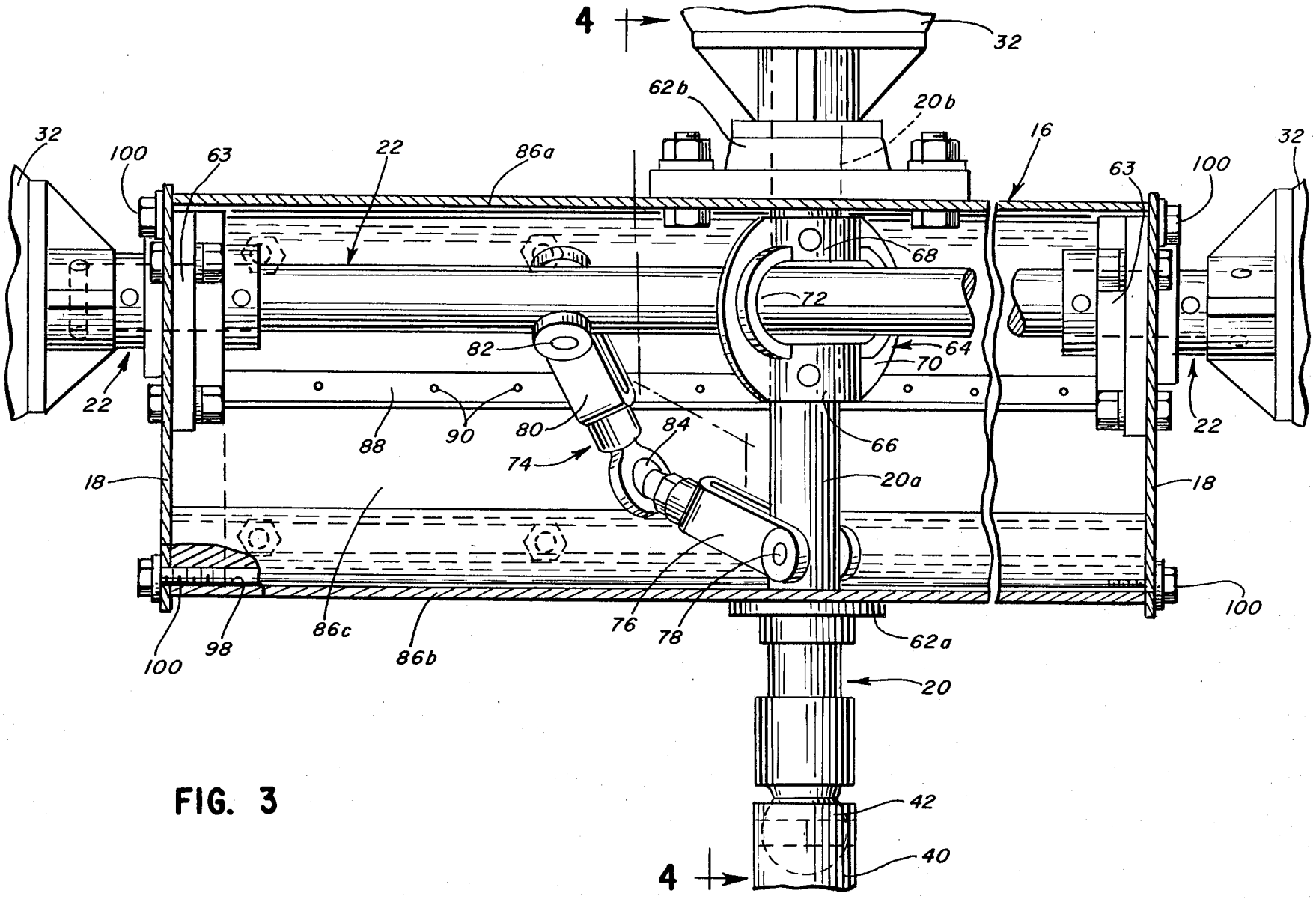
FIG. 3 is a broken, longitudinal vertical section, on a further enlarged scale, through the extruded support base of the invention.
Figure 4:
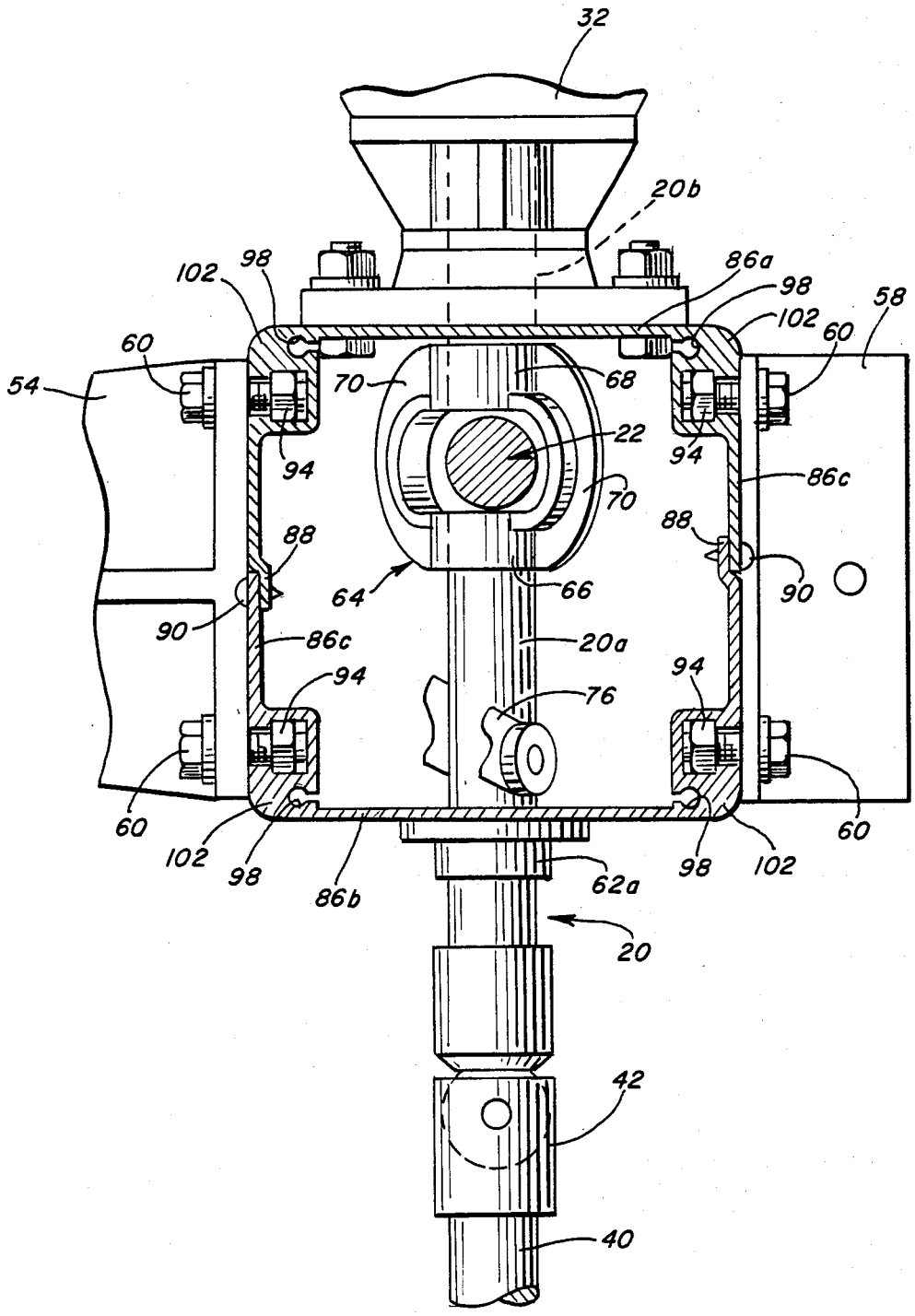
FIG. 4 is a vertical section taken generally along line 4—4 of FIG. 3.

Referring to FIGS. 3 and 4, upright shaft means 20 includes lower and upper shaft members 20*a* and 20*b* which are journalled in bearings 62*a* and 62*b*, respectively, on the bottom and top of base 16. Transverse shaft means 22 is journalled in bearings 63 on end plates 18. The upright shaft means also includes a yoke, generally designated 64, having a lower collar 66 secured to lower shaft member 20*a* and an upper collar 68 secured to upper shaft member 20*b*. The collars are connected by arcuate members 70 which define an opening 72 for receiving transverse shaft means 22. Therefore, the longitudinal axis of shaft means 20 and 22 lie in the same vertical plane.

A mechanical connection, generally designated 74, interconnects upright shaft means 20 and transverse shaft means 22 so that rotation of shaft means 20 causes substantially equal rotation of shaft means 22. The mechanical connection comprises a first link 76 which has a bifurcated end portion, the arms of which flank lower shaft member 20*a* so that the first link may be pivotally mounted upon the lower shaft member by means of a pin 78. A second link 80 has a bifurcated end portion, the arms of which flank transverse shaft means 22 so that the second link may be pivoted on the transverse shaft means by means of a pin 82. Links 76 and 80 are joined by a ball and socket connection 84 so that they are capable of limited universal movement with respect to one another. Therefore, it can be seen that manual rotation of upright operating shaft 40 effects equal rotation of upright shaft means 20 and transverse shaft means 22 for simultaneous operation of all three circuit switches 24, 26 and 28.

The invention contemplates forming elongated base 16 as an assembly of two identical extruded halves fabricated of aluminum or like material. More particularly, referring to FIGS. 3–6, it can be seen that extruded base 16 has a box-like configuration in cross-section to define an upper wall 86*a*, a bottom wall 86*b* and side walls 86*c*. As seen in FIGS. 5 and 6, the base may be fabricated of generally U-shaped mirror halves, with an offset tongue 88 on one side wall 86*c* mating interiorly along the edge 90 of the opposite side wall of the mating half. This mating engagement is best seen in FIG. 4 where rivets 90 are shown to maintain the base halves mated in assembly to form the box-like configuration of the base. The identical halves are formed by two identical lengths of a single extrusion, with one length turned end-to-end and inverted on top of the other. In this manner, the base can be customized for any desired length depending on the needs of the user.

Generally, elongated extruded base 16 and bracket means (such as brackets 10,54 and 58 described in relation to FIG. 2), have complementary interengaging means between the brackets and the elongated base for supporting the brackets and their respective electric power distribution circuit component at any position along the base. More particularly, the complementary interengaging means include receiver slots 92 extending lengthwise along side walls 86*c* of the base. The brackets have positioning means positionable in the receiver slots at any given location therealong. Specifically, the positioning means is provided by enlarged head portions 94 on the inner ends of bolts 60, as best seen in FIG. 4. Of course, the enlarged head portions may comprise nuts threaded onto the bolts. As best seen in FIGS. 5 and 6, slots 92 have reduced dimensioned entry portions 96 behind which head portions or nuts 94 of bolts 60 are captured. This permits the nuts and their respective brackets to be loosened and moved longitudinally of base 16 to any desired position and then clamped in place.

The extruded elongated base 16 also has means for readily securing end plates 18 to the open ends of the base. More particularly, bore means 98 (FIGS. 4 and 6) are extruded integrally with base 16 and terminate at the ends of the base. As seen best at the bottom left-hand end of FIG. 3, these bores receive threaded fasteners 100 for securing end plates 18 closing the ends of extruded base 16.

Referrring to FIGS. 5 and 6, it has been found that by extruding support base 16 of aluminum material with given thicknesses of the walls of the base which define the box-like configuration thereof, loads of up to 10,000 pounds can be supported by any given bracket 10,54 or 58, wherein each bracket utilizes four bolts 60. Each of the bolts thereby would support 2,500 pounds of load. An example of such a structural base 16 would be to fabricate the composite base with square outside dimensions on the order of seven inches. The thickness of top, bottom and side walls 86*a*–86*c*, respectively, would be on the order of 0.125 inch. The walls 100 (FIG. 6) of slots 92 would be on the order of 0.188 inch. Furthermore, it can be seen in FIGS. 4 and 6 that slots 92 and bore means 98 are located adjacent the corners of the box-like configuration. The corners are thickened, as at 102, to provide reinforcement for both the slots and bore means. With these dimensions and configurations, such an extruded base, fabricated of aluminum material, can withstand the aforementioned 10,000 pounds of load by any given bracket, and 2,500 pounds of load by any given bolt 60 and enlarged nut 94.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

I claim:

1. In a group operated electric circuit disconnect apparatus for a plurality of overhead electric power distribution lines carried on poles, the improvement comprising:

an elongated base defined by wall means having integrally formed receiver means extending along a substantial portion of the elongated base;

means for mounting the base on and extending transversely of a pole;

bracket means for connection to an electric power distribution circuit component; and positioning means on the bracket positionable in the receiver means at any given location therealong for supporting the bracket at any position along the base.

2. The improvement of claim 1 wherein said receiver means comprises an elongated slot having a reduced dimensioned entry, and said positioning means includes an enlarged head portion mating within the slot.

3. The improvement of claim 2, including a pair of said slots spaced vertically of and extending generally parallel along the elongated base.

4. The improvement of claim 1 wherein said elongated base comprises an extruded member.

5. The improvement of claim 4 wherein the extruded base is fabricated of aluminum material.

6. The improvement of claim 4 wherein said receiver means comprises an elongated slot extruded along the base.

7. The improvement of claim 6 wherein the extruded base has a box-like configuration in cross-section, said slot being located adjacent a corner of the box, and the corner walls of the box being thickened to provide support for the slot.

8. The improvement of claim 6 wherein the slot has a reduced dimensioned entry, and said positioning means includes an enlarged head portion mating within the slot.

9. The improvement of claim 6 wherein the extruded base has a box-like configuration in cross-section and is fabricated of a pair of generally U-shaped identical halves formed from lengths of a single extrusion, one length being turned end-to-end and inverted on top of the other, and each said half having an extruded slot located on opposite sides of the base when the halves are assembled.

10. The improvement of claim 4 wherein the extruded base has a box-like configuration in cross-section with open ends, and including extruded bore means terminating at said ends for receiving fastening means of appropriate end plates.

11. In a group operated electric circuit disconnect apparatus for a plurality of overhead electric power distribution lines carried on poles, the improvement comprising:

an elongated extruded base having side wall means defining a box-like configuration in cross-section, including an elongated slot extruded integrally within the side wall means and extending along the base, the slot having reduced dimensioned entry;;

means for mounting the base on and extending transversely of a pole; and bracket means for connection to an electric power distribution circuit component, including positioning means having an enlarged head portion for mating within the slot of the base and for sliding movement therealong whereby a power distribution circuit component connected to the bracket means can be positioned and supported at any position along the elongated base.

12. The improvement of claim 11, including a pair of said slots spaced vertically of and extending generally parallel along the elongated base.

13. The improvement of claim 11 wherein the extruded base is fabricated of aluminum material.

14. The improvement of claim 11 wherein said slot is located adjacent a corner of the box-like base, and the corner walls of the box are thickened to provide support for the slot.

15. The improvement of claim 11 wherein the extruded base is fabricated of a pair of generally U-shaped identical halves formed from lengths of a single extrusion, one length being turned end-to-end and inverted on top of the other, and each said half having an extruded slot located on opposite sides of the base when the halves are assembled.

16. The improvement of claim 11 wherein the extruded base has open ends, and including extruded bore means terminating at said ends for receiving fastening means of appropriate end plates.

17. A group operated electric circuit disconnect apparatus for a plurality of overhead electric power distribution lines carried on poles, said apparatus comprising, in combination:

an elongated base mountable on and extending transversely of a pole, the base having a box-like configuration in cross-secrtion;

a base disconnect switch surmounting the base;

second and third diconnect switches mounted at opposite ends of the elongated base;

an upright shaft means journalled on the base, the upright shaft means being operatively connected through the base to said first switch so that axial rotation of the shaft means opens and closes the first switch, said upright shaft means having a lower end connectable to means by which it may be rotated;

elongated transverse shaft means extending longitudinally within and journalled at opposite ends of the elongated base and operatively connected to said second and third switches so that axial rotation of the transverse shaft means opens and closes the second and third switches; and a mechanical connection within the base between the upright shaft means and the transverse shaft means so that axial rotation of the upright shaft means causes axial rotation of the transverse shaft means.

18. The combination of claim 17 wherein said elongated base has opposite end plates through which said transverse shaft means is journalled.

19. The combination of claim 18 wherein said elongated base comprises an extruded member including bore means terminating at the ends thereof for receiving fastening means of said end plates.

* * * * *